US005806457A

United States Patent [19]

Gauthier et al.

[11] Patent Number: 5,806,457

[45] Date of Patent: Sep. 15, 1998

[54] SUBMERSIBLE VEHICLE HULL PORTION HAVING INTEGRALLY FORMED FLUID TANK

[75] Inventors: Benoit G. Gauthier, Little Compton; Dawn M. Vaillancourt, Tiverton, both of R.I.; Stephen J. Plunkett, North Hampton, N.H.

[73] Assignee: The United States of America as represented by the Secretary of the Navy, Washington, D.C.

[21] Appl. No.: 813,586

[22] Filed: Jan. 17, 1997

[51] Int. Cl.[6] ..... B63G 8/00

[52] U.S. Cl. ..... 114/312; 114/65 R; 114/357

[58] Field of Search ..... 114/312, 342, 114/74 A, 74 R, 65 R, 357, 68, 69

[56] References Cited

U.S. PATENT DOCUMENTS

| | | | |
|---|---|---|---|
| 3,167,204 | 1/1965 | Rouse, Jr. | 114/342 |
| 3,598,275 | 8/1971 | Francois | 114/342 |

FOREIGN PATENT DOCUMENTS

| | | | |
|---|---|---|---|
| 351381 | of 0000 | France | 114/342 |
| 171976 | of 1906 | Germany | 114/342 |

*Primary Examiner*—Ed L. Swinehart

*Attorney, Agent, or Firm*—Michael J. McGowan; Michael F. Oglo; Prithvi C. Lall

[57] ABSTRACT

A submarine hull has integrally defined fuel tankage tubes surrounding an inner skin, and a structural foam core in the interstitial annular space not occupied by the tubing. An outer skin completes the structure, both inner and outer skins are of composite construction.

3 Claims, 2 Drawing Sheets

4
3
5
6
2
1
d

SUBMERSIBLE VEHICLE HULL PORTION HAVING INTEGRALLY FORMED FLUID TANK

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to submersible vehicle hulls with fluid tanks provided between inner and outer shells of the hull.

(2) Description of the Prior Art

Submarine hulls have been proposed with inner and outer shells, and with fluid storage chambers provided therebetween. U.S. Pat. No. 988,632 issued to D'equevilley, U.S. Pat. No. 1,175,219 issued to Barraja-Frauenfaelder and U.S. Pat. No. 1,153,267 issued to Spear show several configurations that teach the necessity for completely filling the cavity between the inner and outer hull shells with a fluid to allow for only the inner shell to be maintained at a design internal atmospheric pressure and to withstand the water pressure externally of that inner shell. That is, the space between the two shells is provided at a water pressure dependent on the depth to which the hull is submersed so that the outer hull does not contribute significantly to the integrity of the structure.

Another prior art U.S. Pat. No. 4,282,823 issued to Santi shows a structure for an underwater hull that is required to withstand high external pressure and wherein the hull is composed solely of a plurality of axially spaced toroidal tanks. This structure also teaches that connecting rings be welded between these toroidal tank elements and longitudinally extending beams welded to the toroidal tank elements for axial stability of the structure.

Conventional composite hulls have an inner skin wound on a mandrel, and a foam core applied to the outer surface of the inner skin to a desired depth, after which the core material is machined to provide a cylindrical shape of somewhat larger diameter than that of the inner skin in order to provide a convenient surface for wrapping the outer skin, which is also of composite material, providing the composite hull.

The above-described teachings from the prior art form the background of the present invention wherein a novel tubing arrangement is provided for storing fluid in the core of a composite pressure hull that provides for deep submergence applications, and which eliminates the need for devoting space inside the hull to internal tankage requirements of the type required in submersible vessels generally, i.e., to meet ballast requirements and/or fuel or electrolyte storage for example.

The designer of modern submersible vehicles must balance vehicle payload capacity against vehicle endurance military hull designs, which usually have strict size constraints imposed by reason of their launch platforms, place an even greater premium on vehicle capacity. Internal space devoted to fuel necessarily restricts payload capacity. Internal space devoted to tankage can restrict both payload capacity and endurance. The major advantage of the present invention provides for more efficient use of the internal vehicle volume and eliminates the need for fluid storage outside the pressure hull itself. The need for providing pressurized tanks inside the pressure hull has been eliminated in the present invention. As a result of the invention disclosed, the vehicle hull itself may be used not only for the storage of fluid, but the uniquely configured tankage contributes to the strength of the hull itself. In addition to the fluid storage, the tubing may also be arranged as a heat exchanger for use in propulsion systems where cooling is required from the surrounding sea water in which the vehicle is designed to travel.

SUMMARY OF THE INVENTION

The general purpose and object of the present invention is to provide for novel tankage or fluid storage means within the hull structure of a pressure hull such that the tankage structure contributes to the structural strength of the composite hull configuration itself.

Another object of the subject invention is to provide for more efficient use of the internal vehicle volume.

Still another object of the subject invention is to eliminate the need for fluid storage outside the pressure hull itself.

These objects are accomplished with the present invention by providing an inner composite skin of generally cylindrical shape formed by laying up the skin on a conventional mandrel to a desired thickness. A thin layer of uncured foam core is provided on the outer surface of the inner skin and on the inner surface of the tubing assembly, filling the interstitial voids. The tubing is slid over the inner skin prior to foam curing. Another application of core material is provided in the space between the tubing assembly to a depth somewhat in excess of that defined by the outside diameter of the tubing. The excess core material is then machined down to the outside diameter of the tubing assembly. A second hull skin material is wound around this machined shape to form a very light weight but nevertheless very strong hull structure which is capable of storing a fluid inside the tubing assembly.

BRIEF DESCRIPTION OF THE DRAWINGS

Various objects, advantages, and novel features of the subject invention will be more fully apparent from a reading of the following detailed description in conjunction with the accompanying drawings wherein.

DESCRIPTION OF THE PREFERRED EMBODIMENT

Figure 1:
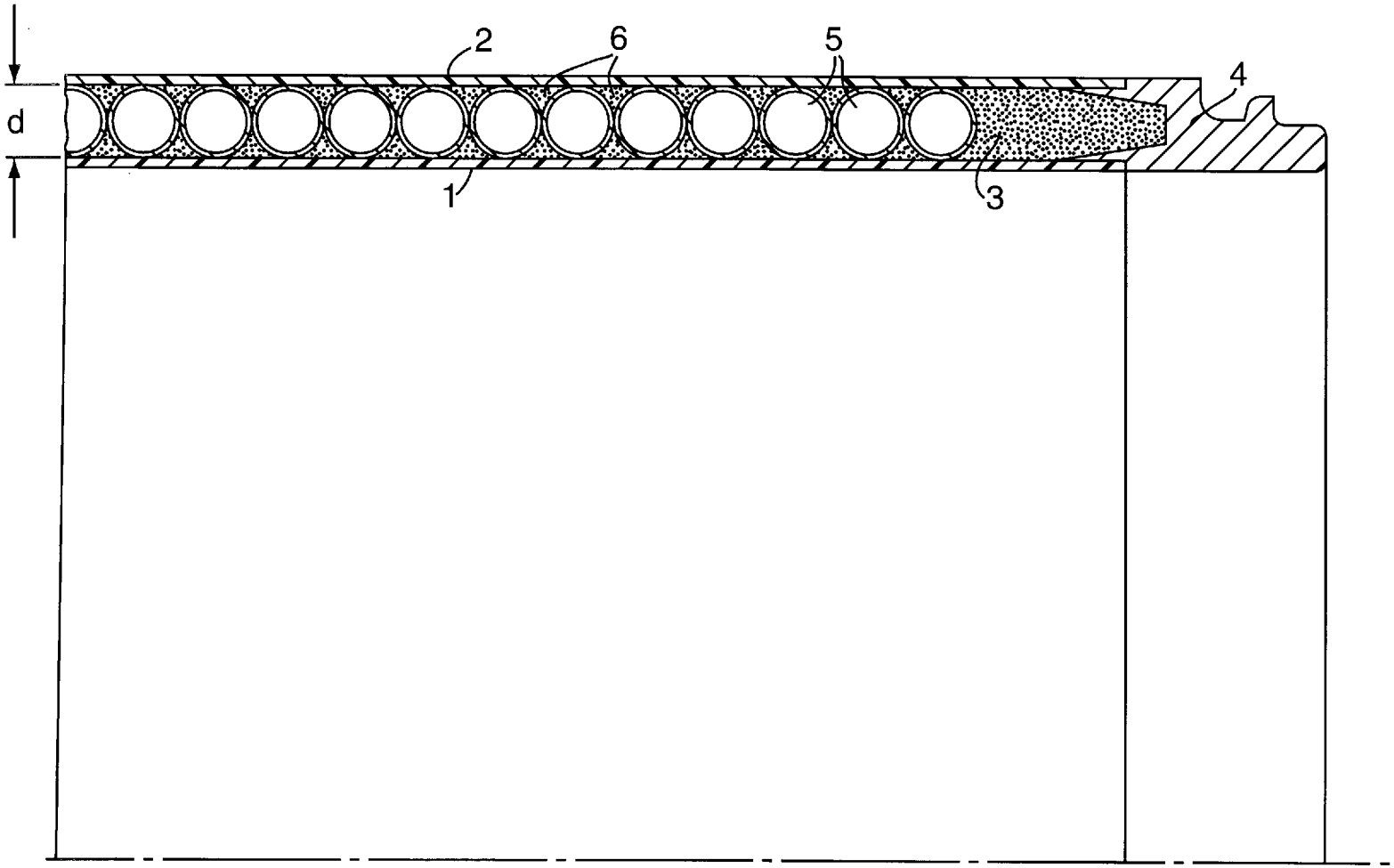
FIG. 1 is a schematic illustration of the hull according to the teachings of subject invention.

Referring now to FIG. 1 in greater detail, the major components of a hull structure constructed in accordance with the present invention are shown to comprise an inner stressed skin 1 which is formed by wrapping a composite material on a mandrel (not shown) to a desired thickness. The composite material is comprised of high strength filaments, or cloth, embedded in a suitable matrix or resin.

A second component of the hull structure comprises the outer skin 2 which is generally similar to the inner skin 1, but which is similarly formed by wrapping or winding, but not before applying a layer of foam core material to the outside surface to the inner skin 1. The distance between the inner skin 1 and outer skin or second skin 2 is generally several times the thickness of the skins themselves. In addition to maintaining a separation distance between the skins, the core material provides a means of stress transfer between the skins. Both these functions serve to increase the section modulus, stability, and strength of the hull. In the subject invention, the tankage tubes replace some of the core material while providing the same structural functions. It is preferred that the tank tubes be formed in a welded cylindrical assembly prior to mounting on to the inner skin. The inner surface of the tube assembly is plastered with uncured foam core material as was the outer surface of the inner skin on the mandrel. The tube assembly is slid onto the inner skin prior to curing of the foam. For maximum volume efficiency, it is preferred that the inner diameter of the tube assembly be nearly equal to the outer diameter of the inner skin, and is preferred that the outer diameter of the tube assembly is nearly equal the inner diameter of the outer skin, neither case is necessary. Foam core material will occupy any volume between the skins which is not occupied by tankage tubes.

Once the tubing 5 has been wound around the inner skin over this limited application of core material, a second application, of core material is provided to fill the outwardly open cavities defined between the tubing assembly which is not yet filled with such core material.

After the second application of core material has set, the external surface of the resulting partially formed hull structure is machined down to a diameter that will expose the outer surface of the tubing 5. Following this machining step, the outer skin 2 is laid up around the machined surface so as to provide a very strong hull structure having integrally formed fluid storage in accordance with the present invention.

Figure 2:
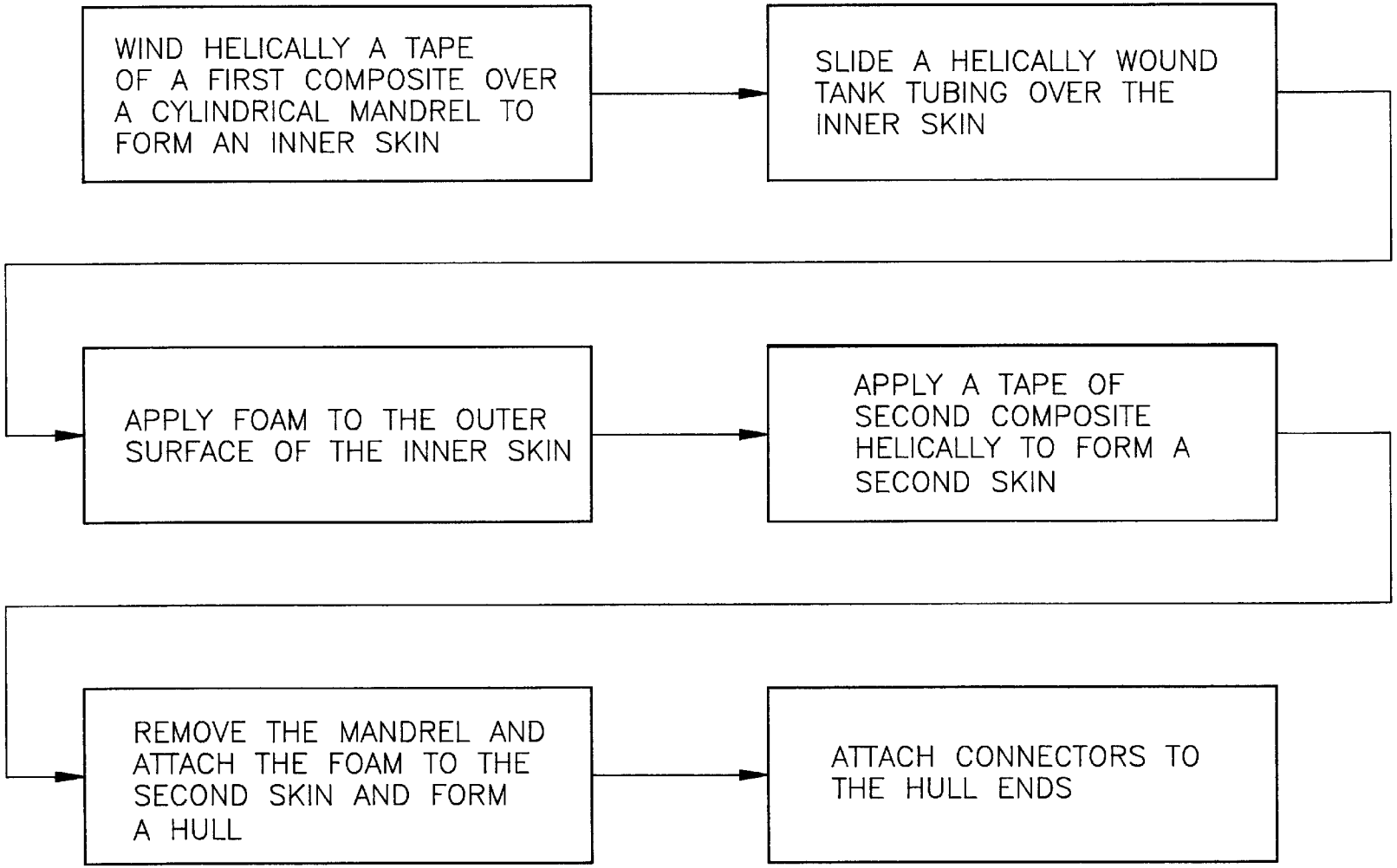
FIG. 2 is a block diagram of the process to fabricate a hull according to the teachings of subject invention.

FIG. 2 shows as a block diagram the process used to fabricate the hull according to the teachings of subject invention.

The hull structure so obtained provides a higher cross-sectional rigidity than has been possible heretofore with composite hull structures generally. The resulting hull structure yields a very high buckling strength under hydrostatic loading such as occurs during deep submergence operations. Conventional composite hull structures require a core material that must be rigid in through-the-thickness compression, i.e., the core material must have compressive strength slightly higher than the maximum depth pressure to which the hull would be subjected. In the improved hull structure disclosed herein, the tubing lends an added resistance to hydrostatic loading that is not possible with conventional core material applications. In effect, the tubing provided in accordance with the present invention replaces a majority of the core material and serves to increase the maximum stress which can be sustained by a composite hull structure constructed in accordance with the present invention. The maximum stress on the tubing will be a result of its internal fluid pressure, and is dictated by the design depth pressure of the hull, which is directly proportional to the diameter (d) of the tubing and inversely proportional to the thickness of the tubing side wall. The relatively small diameter of the tubing enables these tubes to carry a fluid at full pressure with minimal tubing wall thickness, a result which yields weight savings in the hull structure.

Still with reference to the FIG. 1, an annular fitting 4 is provided at the end of the generally cylindrical hull structure, to either mate with an adjacent hull section, or to receive a nose cone or tail cone of the submersible vessel (not shown). In order to provide fluid access to the tubing assembly shown in the figure, plumbing fittings (not shown) would be provided either through the annular fitting 4 or instead might be provided through the inner skin 1 of the composite hull structure. Although such plumbing is not shown, its design will be readily apparent to those skilled in the art. Fluid access to the interior of the tubing poses a relatively simple task to the designer who will take advantage of the present invention to increase hull strength while at the same time gaining the advantage of further fluid storage or tankage in a modern day submersible vessel.

An alternate form of this invention could be built wherein the inner and outer skins are metallic rather than composite. Such a structure would not be as lightweight as one using high strength composite skins, but would still be an effective pressure hull for hydrospace applications.

In light of the above, it is therefore understood that within the scope of the appended claims, the invention may be practiced otherwise than as specifically described.

What is claimed is:

1. A hull portion of a submersible vehicle which comprises:

an inner skin of generally cylindrical shape wherein said inner skin is formed from a composite material wound on a generally cylindrical mandrel;

an outer skin spaced from said inner skin by a distance d and cooperating with said inner skin to define a generally annular cavity; and fluid storage tubing in said annular cavity, said tubing having an outside diameter of approximately equal to distance between said inner skin and said outer skin, and wherein said tubing is wound helically around said inner skin, said outer skin also of composite material and being wound around said tubing.

2. The combination according to claim 1 wherein said inner and outer skins are fabricated from a composite material, and wherein a core material is provided in the annular cavity not occupied by said tubing.

3. The combination according to claim 2 wherein said tubing is wound helically around said outer skin.

* * * * *